United States Patent [19]

Odhner

[11] Patent Number: 4,881,740

[45] Date of Patent: Nov. 21, 1989

[54] BOARD GAME METHOD OF PLAY

[76] Inventor: Hugo V. Odhner, P.O. Box 185, Bryn Athyn, Pa. 19009

[21] Appl. No.: 112,288

[22] Filed: Oct. 26, 1987

[51] Int. Cl.[4] ..... A63F 3/00

[52] U.S. Cl. ..... 273/248

[58] Field of Search ..... 273/248, 249, 246, 146

[56] References Cited

U.S. PATENT DOCUMENTS

| | | | |
|---|---|---|---|
| 1,616,328 | 2/1927 | Nix | 273/246 |
| 1,666,788 | 4/1928 | Palumbo | 273/248 |
| 2,557,583 | 6/1951 | Vitale | 273/248 |
| 3,834,709 | 9/1974 | Lamb | 273/246 |

*Primary Examiner*—Edward M. Coven
*Assistant Examiner*—Benjamin Layno
*Attorney, Agent, or Firm*—Ferrill and Logan

[57] ABSTRACT

The present invention employs a method of negative dice scoring in which multiple dice are thrown and the score of the dice is the sum of any numbers not shown on the dice. The game is readily combined with unique board apparatus in which one or more playing pieces race along intersecting and overlapping paths from a start to a finish.

7 Claims, 2 Drawing Sheets

BOARD GAME METHOD OF PLAY

BACKGROUND OF THE INVENTION

The present invention relates to games of chance and skill employing dice. More particularly, the present invention provides a new method for scoring throws of conventional dice and a corresponding board game.

Dice games are presently well known. The popular game of Yahtzee, produced by E.S. Lowe Co., Inc., employs five dice which may be rolled three times per turn, first all together and then selectively. The object of the game is to achieve the highest Positive score on the dice and/or the best predetermined bonuses for poker-like combinations (e.g. a straight, a four of a kind, a full house). The game is scored on a score card.

Similar positive scoring of dice have been employed in numerous other games which combine the chance of a dice throw with movement around a board. Such games include backgammon, Parcheesi, produced by Essanar Co., and the games disclosed in U.S. Pat. Nos. 3,043,594 issued to Seitz and 3,433,483 issued to Ellis.

Although each of these games provides its own degree of challenge and enjoyment, the use of the dice in these games has varied very little. Accordingly, once a player becomes familiar with the basic concept of positive scoring of the dice, the game must offer rules and other game activities of increasingly greater complexity in order to maintain the interest of more sophisticated players. Such games become increasingly difficult to learn and more time-consuming to play.

Accordingly, it is a primary object of the present invention to provide a unique method of dice scoring which is readily learned but provides a high degree of interest and challenge in and of itself.

It is a further object of the present invention to provide a challenging yet easily understood board game which employs as an integral element the unique method of dice scoring.

SUMMARY OF THE INVENTION

The present invention provides a unique method of scoring dice rolls for determining the movement of playing pieces on a game board The game of the present invention employs a concept of negative dice scoring in which multiple dice are rolled and the score of the dice is a sum of any numbers not shown or "selected" on the dice. A further refinement of this basic game is to subtract from the not-selected numbers any duplicate numbers selected.

The above game may be combined with a board game in which multiple intersecting and overlapping paths are employed and each player attempts to use negative dice scoring to race one or more playing pieces from a start to a finish. Playing pieces which can travel on only specific paths and rules for jumping over and capturing occupied spaces add additional levels of sophistication to the game. The nature of the dice scoring of the present game provides so many possible combinations of moves for playing pieces that the present board game can be played as a strictly strategic game, virtually eliminating the elements of chance.

The games of the present invention are easy to learn, yet provide endless levels of complexity and create a challenge for players of all ages.

DETAILED DESCRIPTION OF THE INVENTION

The present invention discloses an entirely new method of throwing and scoring dice, and a unique board game in which such dice scoring techniques may be employed.

The method of dice throwing of the present invention operates on a principle of negative dice scoring. The present invention may be used with any conventional dice, including four-sided, six-sided, eight-sided, twelve-sided or twenty-sided, as well as with an electronic random number generator. For purposes of simplicity, standard six-sided dice will be referred to by way of example hereinafter.

Conventionally, dice are thrown with a score being derived from the positive amount of the numbers appearing on their upward faces. In the present invention, the dice are selected to be one less in number than the number of faces each contain. Accordingly, when rolled, one or more faces of the dice will not be facing uPward; these not-selected numbers form the basis for scoring the present game.

Figure 1:
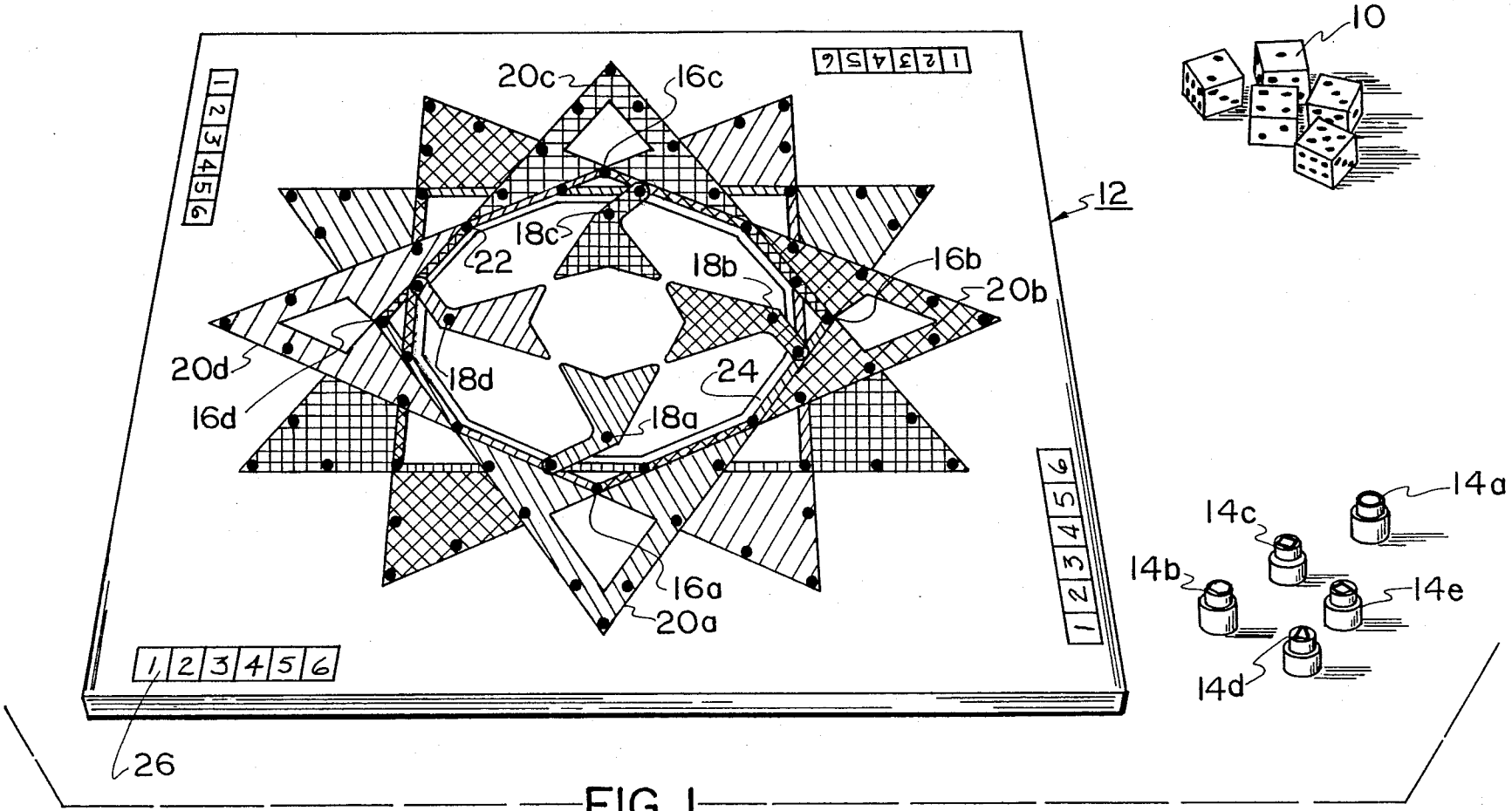
FIG. 1 is a perspective view of the game board apparatus employed in the present invention, the dice and the playing pieces shown somewhat enlarged for detail.

By way of example, when standard six-sided dice are employed, each consecutively numbered from one (1) to six (6), five dice are used in the game. If, as shown in FIG. 1, the dice 10 produce numbers 1, 2, 3, 4, and 5, the not-selected number will be 6. Thus, the score from that dice throw will be 6.

The inventor has found that the game is further improved if any duplicate selected numbers are subtracted from the not-selected numbers before a final score is determined. In the example above, where no duplicate number is present, the score remains 6. In a case where the dice roll is 2, 2, 3, 3, and 6, the sum of the not-selected numbers is $1+4+5$ or 10. From this sum is subtracted the duplicate numbers (i.e. $2+3$ or 5) which provides a final score of 5 (i.e. 10 minus 5).

From this basic game a whole variety of interesting combinations and modifications have been derived. One change is to permit each player to select one or more of the dice to be rolled again to achieve the best possible score. It has been found that the total number of dice re-rolls should be limited to two or three to maintain the momentum of the game.

Since it is possible to accumulate negative totals with the basic game (e.g. a throw of 6, 6, 6, 6, and 6 produces a score of negative 9) (i.e. $1+2+3+4+5$ (15) minus $6\times4$ (24)), a further modification is to provide that duplicate numbers have no more effect than to eliminate, or to be subtracted from, the largest not-selected numbers provided. Accordingly, in the example provided above, each of the duplicate numbers may be subtracted from one of the four largest not-selected numbers, leaving a positive score of 1 (i.e. each of the four sixes cancels out 2, 3, 4, and 5).

The most interesting modification of the basic game is to apply it to a new form of board apparatus. As is shown in FIGS. 1 and 2, a playing board 12 has been developed which is distinctly designed to complement the dice game of the present invention.

The playing board 12 shown provides facilities for up to four players. Each player is provided with: five playing pieces 14*a*, 14*b*, 14*c*, 14*d*, and 14*e*, each distinctly marked; and a respective start position 16*a*, 16*b*, 16*c*, or 16*d*, and finish position 18*a*, 18*b*, 18*c*, or 18*d*. The board 12 comprises four superimposed triangles 20*a*, 20*b*, 20*c*, and 20*d*, each shifted ninety degrees from its adjacent one. Preferably the triangles 20 and the playing pieces 14 should be different colors for each player to assist in associating the starts 16 and finishes 20 of each player with its playing piece 14.

Along the edge of each triangle 20 and within the perimeters of the triangles 20 are various spaces 22 which comprise a series of paths 24 leading from each player's start 16 to finish 18. Although there are a very large number of possible paths 24 leading from each player's start 16 to finish 18, for the purpose of simplicity of play, the number of potential paths 24 have been limited. In addition to adding simplicity to the basic board game, limiting the number of paths also provides another unique aspect of the present invention.

Figure 2:
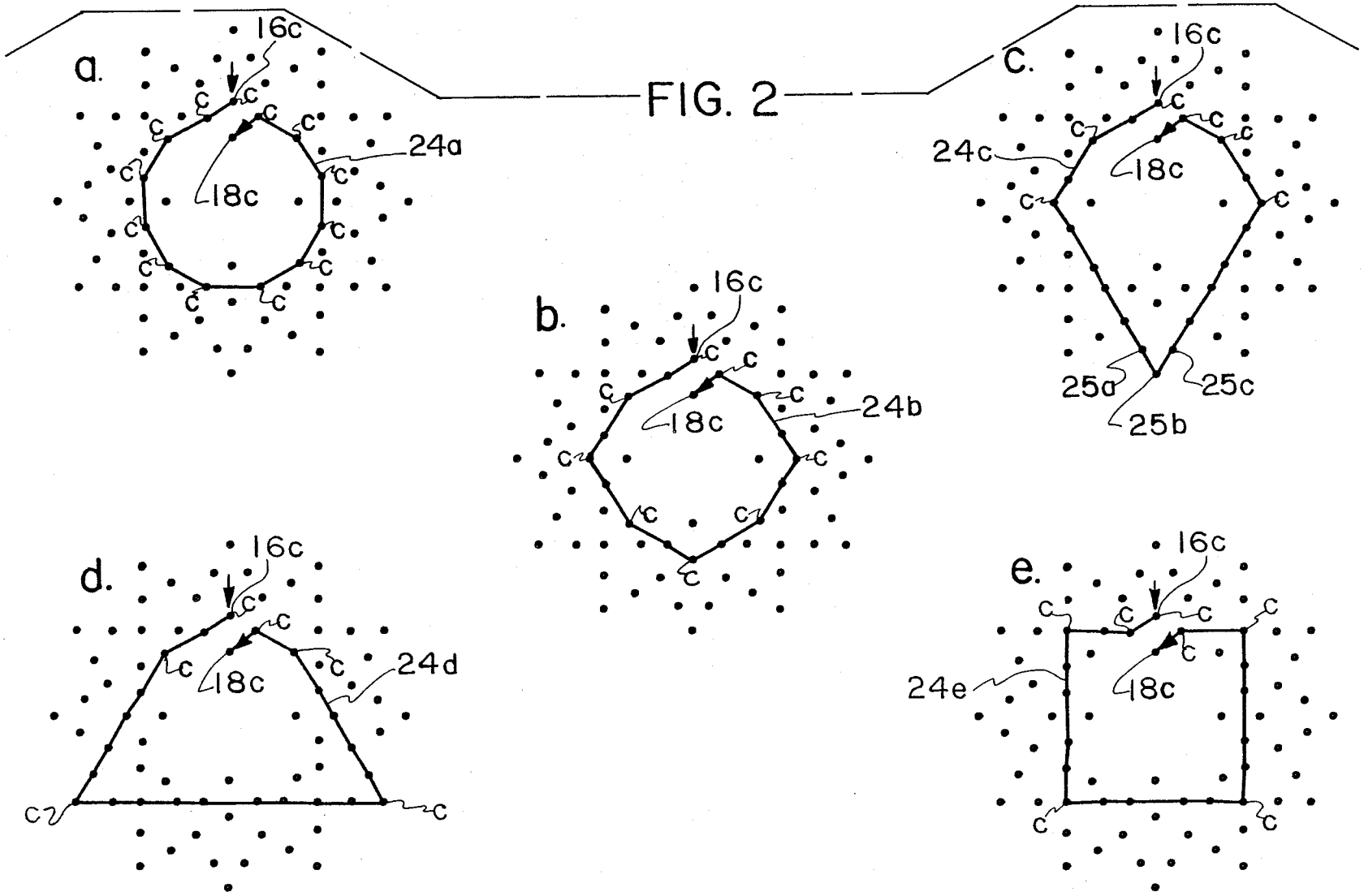
FIG. 2 *a–e* are representations of five arbitrary paths to travel on the game board shown in FIG. 1 from one start position to its corresponding finish position.

By way of example, five possible paths have been set out in FIG. 2, each leading from start 16*c* to finish 18*c*. Each of these paths 24*a*, 24*b*, 24*c*, 24*d*, and 24*e* provides a course of a different length. The playing pieces 14 are each provided with a specific marking 26 which corresponds to one of the five paths. The object of the board game then becomes attempting to move each of the five playing pieces 14 over a corresponding one of the five paths 24 from the start 16 to the finish 18 in the fewest number of turns.

Further excitement and challenge can be added to the game by requiring that the finish 18 can only be reached on an exact count and that no two pieces can occupy the same space at the same time. In order to implement the second of these two rules, a further modification has been developed.

Whenever a progressing playing piece 14 encounters an occupied space, the piece may either jump over the occupied space or may capture the space and move the occupying piece elsewhere on the board 12, or otherwise disrupt its progress, such as causing it to lose a turn. Due to the busyness of the innermost paths 24 on the board 12, it has been found that merely moving the occupying piece backward one space is a sufficient penalty.

A further modification of this concept is to require that occupied spaces encountered on straight segments of a path be jumped over and occupied spaces encountered at corner segments of a path be captured, automatically moving the occupying piece 14 backward. As is set forth in FIG. 2, the spaces which are captured using this method are marked with "C"; the remaining spaces on each path will be jumped. It should be noted that only one piece will ever travel on three spaces 25*a, b, c* on FIG. 2*c*, thus avoiding any possibility of a jump or capture on those spaces. An additional refinement gives each player the option to decide whether to count the space skipped or captured as a space in a turn.

It has been found that the tallying of scores for each turn is greatly simplified by providing a tally grid 26 on each side of the board 12. The tally grid 26 contains one number corresponding to each number of the faces of a die. After the dice are rolled, and re-rolled if necessary, the player then covers each number rolled. Duplicate numbers are then placed beside the uncovered numbers, the largest duplicate numbers besides the largest uncovered numbers and so on down to the smallest numbers. If the duplicate number is larger than its corresponding uncovered number, the uncovered number is then covered; if the duplicate number is smaller than its corresponding uncovered number, the uncovered number is mentally adjusted to be the difference between the two numbers. Multiple smaller numbers may be combined at the player's option to subtract more from any given uncovered number so long as the uncovered number is not exceeded.

Once the dice have been arranged on the tally grid in this manner, the player can then move any one of its playing pieces 14 the number of spaces remaining on any uncovered number. Although each playing piece 14 may not be moved less than any uncovered number, multiple uncovered numbers may be combined to advance any single piece 14 further. The effect of using the tally grid 26 is to produce the same score provided using the no-negative-number option described above.

A further embodiment of the present invention may include creating a strictly strategic game by requiring all players to use the same dice throw for a given turn or for an entire game. This virtually eliminates the chance element and forces the players to arrange the dice 10 and maneuver their playing pieces 14 in the most strategic manner possible.

While particular embodiments of the present invention have been disclosed herein, it is not intended to limit the invention to such a disclosure, and changes and modifications may be incorporated and embodied within the scope of the following claims.

What is claimed is:

1. A method of playing a board game with at least one player playing in turn on a playing board having at least one path, said path having a predetermined number of spaces and a defined start and finish, which method comprises providing at least one die, each die having multiplied numbered faces, the total number of dice being at least one less than the total number of faces on any die;

rolling the dice to provide a randomly selected number on each die;

wherein a tallying means is provided which comprises a series of numbers, each corresponding to a different number on each of the faces of a die, and scoring is accomplished by eliminating each number on the tallying means with a corresponding number selected on a die and summing any numbers not eliminated;

each player provided with multiple playing pieces and moving at least one playing piece along a path, progression through the spaces determined by the dice score each turn;

determining a winner by the player who progresses each of its playing pieces from the start to the finish.

2. A method in accordance with claim 1 wherein at least one of the dice may be selected to be rolled at least once again prior to scoring each turn.

3. A method in accordance with claim 1 wherein said board is provided with multiple intersecting and overlapping paths, each path comprising both straight and corner segments, and whenever a player's playing piece encounters a space occupied by another playing piece while progressing in a straight line along a path, the progressing player's playing piece skips the occupied space, and whenever a player's playing piece encounters another playing piece at a corner, the encountered playing piece is moved to another position on the board.

4. A method in accordance with claim 3 wherein each of the playing pieces is moved along only a particular path.

5. A method in accordance with claim 1 wherein scoring is accomplished by eliminating each number on the tallying means with the corresponding number selected on a die, eliminating any numbers left by any larger duplicate selected number, adjusting any remaining numbers by subtracting any smaller duplicate selected number, and scoring the move of any given playing piece by the sum of at least one adjusted number not eliminated.

6. A method playing a board game with at least one player playing in turn on a playing board having at least one path having a predetermined number of spaces and a defined start and finish, which method comprises providing at least one die, each die having multiple numbered faces, the total number of dice being at least one less than the total number of faces on any die;

arranging the dice to provide a number on each die;

wherein a tallying means is provided which comprises a series of numbers, each corresponding to a different number on each of the faces of a die, and scoring is accomplished by eliminating each number on the tallying means with a corresponding number selected on a die and summing any numbers not eliminated;

each player provided with multiple playing pieces and moving at least one playing piece along a path, progression through the space determined by the score each turn;

determining a winner by the player who progresses each of its playing pieces from the start to the finish.

7. A method in accordance with claim 6 wherein said board is provided with multiple intersecting and overlapping paths, each path comprising both straight and corner segments, and whenever a player's playing piece encounters a space occupied by another playing piece while progressing in a straight line along a path, the progressing player's playing piece skips the occupied space, and whenever a player's playing piece encounters another playing piece at a corner, the encountered playing piece is moved to another position on the board.

* * * * *